US006533097B1

(12) United States Patent
Sakamoto et al.

(10) Patent No.: US 6,533,097 B1
(45) Date of Patent: Mar. 18, 2003

(54) SHEET MATERIAL TRANSFER DEVICE

(75) Inventors: Yuichi Sakamoto, Higashimatsuyama (JP); Shigeru Yasuda, Tsurugashima (JP); Koji Akiba, Sakado (JP); Makoto Yamamoto, Takamatsu (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/439,780

(22) Filed: Nov. 12, 1999

(30) Foreign Application Priority Data

Nov. 13, 1998 (JP) ..... 10-323739

(51) Int. Cl.[7] ..... H05F 3/00
(52) U.S. Cl. ..... 194/206; 361/214
(58) Field of Search ..... 194/206, 207; 271/193, 208; 361/212, 214, 220

(56) References Cited

U.S. PATENT DOCUMENTS 4,114,804 A * 9/1978 Jones et al. ..... 194/207 X
4,334,262 A * 6/1982 Latos ..... 362/13 X
4,493,639 A * 1/1985 Suster ..... 362/13 X
4,862,208 A * 8/1989 Yamada et al. ..... 354/485 X
5,671,123 A * 9/1997 Omori et al. ..... 361/212 X

FOREIGN PATENT DOCUMENTS

JP 3-241790 A * 10/1991
JP 9-64384 A * 3/1997

* cited by examiner

*Primary Examiner*—Eileen D. Lillis
*Assistant Examiner*—Thuy V. Tran
(74) *Attorney, Agent, or Firm*—Hogan & Hartson, LLP

(57) ABSTRACT

Grounding member (11) for grounding static electricity generated in sheet material transfer rollers (32) of the sheet material transfer device (1) comprises a circuit pattern for grounding (14) formed on a printed circuit board (13) and of an electrically conductive force applying member (12) having one end (12*a*) in contact with a shaft (33) and another end (12*b*) in contact with the circuit pattern for grounding (14) for always pressing the sheet material transfer rollers (32) toward a sheet material transfer path (30) and discharges static electricity generated in the sheet material transfer rollers (32) through the shaft (33), the force applying member (12) and the circuit patterns for grounding (14).

1 Claim, 2 Drawing Sheets

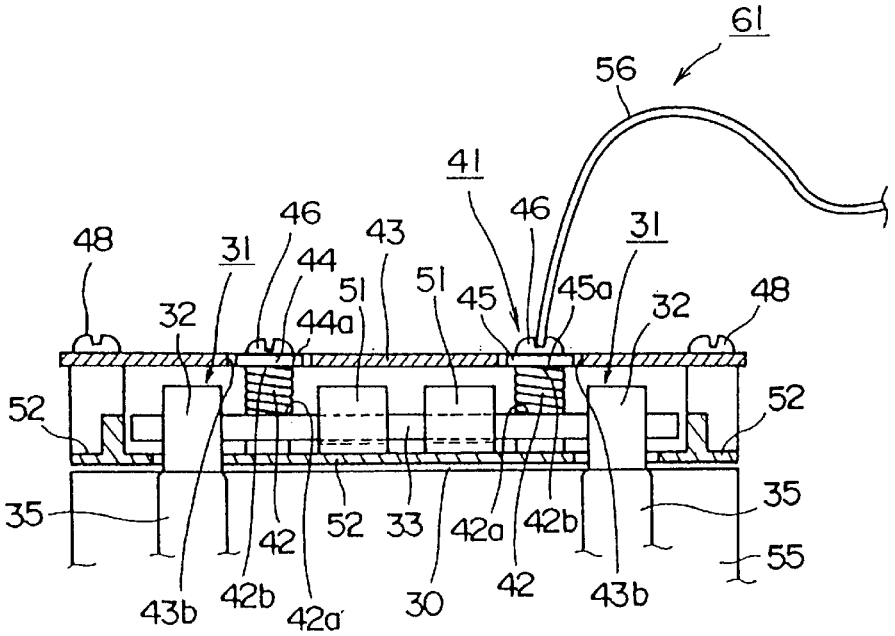
PRIOR ART Fig. 3
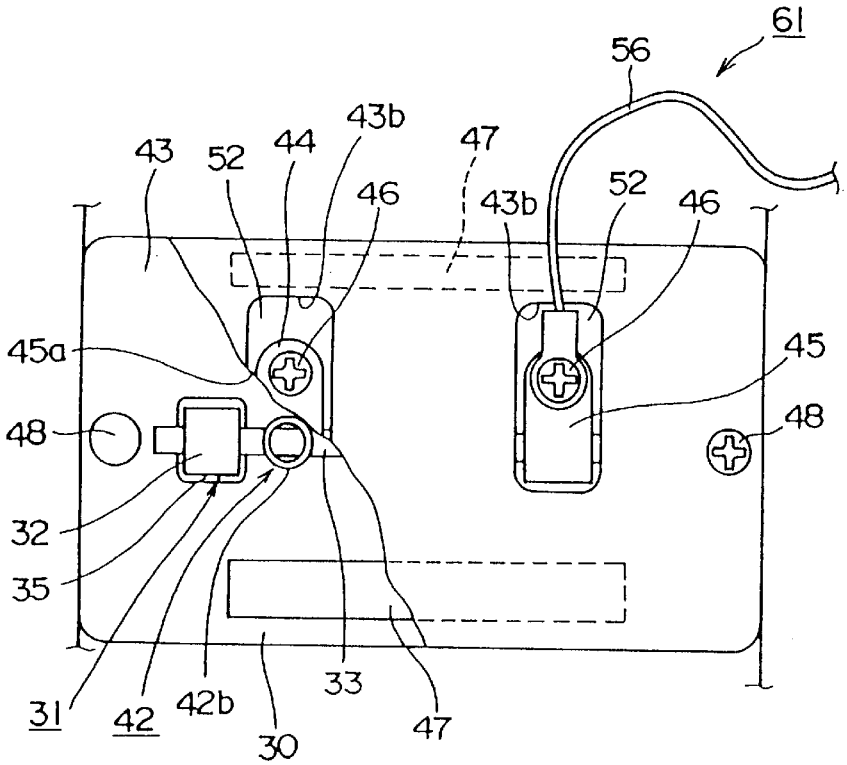
PRIOR ART Fig. 4

SHEET MATERIAL TRANSFER DEVICE

BACKGROUND OF THE INVENTION

1. Field of the Invention

The present invention relates to a sheet material transfer device to be used for a vending machine, money changer, pinball lending machine, metal lending machine, and the like.

2. Description of the Related Art

Generally, in a vending machine for handling sheet materials such as bills, coupon tickets and the like, a sheet material transfer device for transferring sheet materials inserted from the sheet material insertion port is arranged in the body of the vending machine.

This sheet material transfer device is, for example, a bill transfer device for transferring bills inserted from the bill insertion port.

FIG. 3 is a schematic cross sectional view of the essential portion of a conventional bill transfer device and FIG. 4 is a schematic top view of the essential portion of the conventional bill transfer device of FIG. 3.

This conventional bill transfer device 61 comprises bill transfer means 31 including a pair of bill transfer rollers 32 for transferring bills inserted from a bill insertion port not shown in the drawing along a bill transfer path 30, magnetic heads 35 for discriminating the truth of bills transferred by the bill transfer means 31, and grounding means 41 for grounding static electricity generated in the bill transfer rollers 32 by friction with transferring bills.

Among them, the pair of bill transfer rollers 32 constituting the bill transfer means 31 are rollers arranged in the bill transfer path 30 in the neighborhood of a printed circuit board 43 so as to freely move vertically and are made of synthetic resin.

Each of the bill transfer rollers 32 is supported via a shaft 33 made of an electrically conductive material so as to freely rotate and always pressed toward the bill transfer path 30 by the pressing force of coil springs 42, which will be described later, via the shaft 33.

A pair of guide plates 51 arranged between the bill transfer rollers 32 restrict the motion of the bill transfer rollers 32 in the vertical direction only.

The magnetic heads 35 are arranged in the opposite locations of each of the bill transfer rollers 32 across the bill transfer path 30.

The grounding means 41 comprises the pair of coil springs 42 made of an electrically conductive material, a pair of electrically conductive plate members and 45, and a pair of screws 46.

Among them, each of the coil springs 42 has one end 42*a* in contact with the shaft 33 and another end 42*b* in contact with an lower face 44*a* of the plate member 44 or an lower face 45*a* of the plate member 45.

The plate members 44 and 45 are positioned in holes 43*b* formed in the printed circuit board 43 and fixed to upper chutes 52 by the screws 46.

The plate members 44 and 45 are in contact with the other ends 42*b* of the coil springs 42 on the lower faces 44*a* and 45*a* thereof. The plate member 45 is made of an electrically conductive material and supports a lead terminal 56 for grounding outside the bill transfer device 61.

On the printed circuit board 43, circuit patterns 47 (FIG. 4) for controlling the whole processing of bills including bill transfer are formed. The printed circuit board 43 is fixed to the upper chutes 52 by a pair of screws 48. Numeral 55 shown in FIG. 3 indicates a lower chute.

The bill transfer device 61 transfers bills inserted from a bill insertion port not shown in the drawing along the bill transfer path 30 by the bill transfer means 31 and also drives the magnetic heads 35 when the bills pass between the magnetic heads 35 and the bill transfer rollers 32 and thus discriminates the truth of the bills. When the bills are discriminated as true bills by the magnetic heads 35, the bill transfer device 61 further transfers the bills to the downstream of the bill transfer path 30 by the bill transfer means 31 and stores them in a stacker not shown in the drawing. When the bills are discriminated as false bills, the bill transfer device 61 reversely drives the bill transfer means 31 and returns the bills from the bill insertion port.

To assemble the bill transfer device 61, the pair of coil springs 42 constituting the grounding means 41 is arranged so that the one ends 42*a* thereof come in contact with the shaft 33 supporting the bill transfer rollers 32. Thereafter, the plate members 44 and 45 are positioned so that the lower faces 44*a* and 45*a* thereof come in contact with the other ends 42*b* of the coil springs 42 and also fixed to the upper chutes 52 by the screws 46. Next, the printed circuit board 43 is positioned so that the plate members 44 and 45 are arranged in the holes 43*b* thereof. The plate members 44 and 45 are fixed to the upper chutes 52 by the screws 48.

In the bill transfer device 61, since the bill transfer rollers 32 are made of synthetic resin, static electricity is generated in the bill transfer rollers 32 by friction with transferring bills, and therefore, it is so designed that the static electricity is discharged via the shaft 33, the coil springs 42 and the plate member 45. Therefore, a risk of static electricity staying in the bill transfer rollers 32 is prevented and hence a risk that the operation of the printed circuit board 43 may be adversely affected by staying of the static electricity, that is, malfunctions of the bill processing may be caused is prevented.

Meanwhile, the aforementioned bill transfer device 61 has a structure that the coil springs 42 constituting the grounding means 41 are fixed to the upper chute 52 via the plate member 44 or 45 and the screws 46 at the one ends 42*a* thereof, and further, the printed circuit board 43 is fixed to the upper chute 52 by the screws 48. As a result, a problem arises that there are many components required and the manufacturing process is complicated.

This problem also arises in a sheet material transfer device for transferring sheet materials other than bills.

SUMMARY OF THE INVENTION

An object of the present invention is to provide a sheet material transfer device capable of preventing the stay of static electricity in the sheet transfer rollers in the neighborhood of a printed circuit board and hence preventing malfunctions of the sheet material process of the printed circuit board.

Another object of the present invention is to provide a sheet material transfer device having a relatively small number of components and whose manufacturing process is simple.

To accomplish the above objects, the present invention provides a sheet material transfer device comprising at least sheet material transfer rollers vertically movable and arranged in a sheet material transfer path in neighborhood of a printed circuit board and supported so as to freely rotate by means of an electrically conductive shaft and a grounding means for grounding static electricity generated in said sheet material transfer rollers, wherein the grounding means includes a circuit pattern for grounding formed on the printed circuit board; and electrically conductive force applying means having one end in contact with the shaft and another end in contact with the circuit pattern for grounding, for always pressing the sheet material transfer rollers toward the sheet material transfer path, and wherein the grounding means discharges static electricity generated in the sheet material transfer rollers via the shaft, the force applying means, and the circuit pattern for grounding.

Other object and effects of the present invention can be easily ascertained by the following detailed description and accompanying drawings.

BRIEF DESCRIPTION OF THE DRAWINGS

FIG. 3 is a schematic cross sectional view of the essential portion of a conventional bill transfer device; and FIG. 4 is a schematic top view of the essential portion of the conventional bill transfer device of FIG. 3.

DESCRIPTION OF THE PREFERRED EMBODIMENTS

As an embodiment of a sheet material transfer device according to the present invention, a bill transfer device that transfers bills will be described hereunder in detail.

Figure 1:
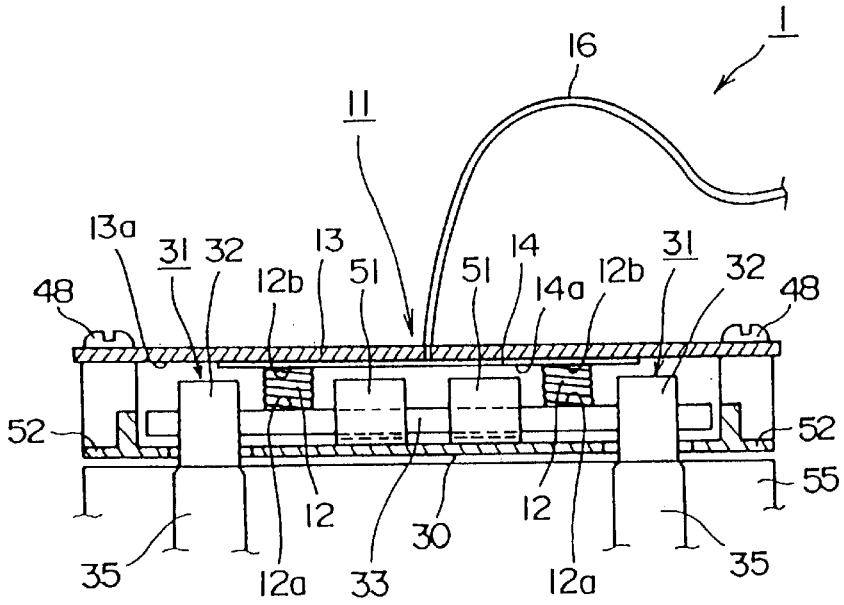
FIG. 1 is a schematic cross sectional view of the essential portion of a bill transfer device which is an embodiment of a sheet material transfer device according to the present invention.
Figure 2:
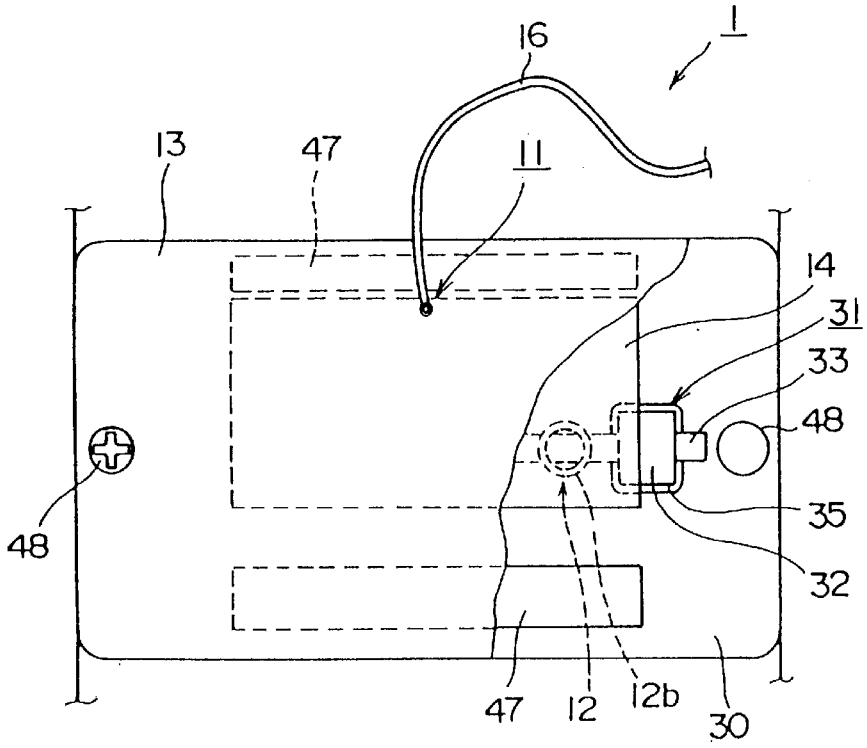
FIG. 2 is a schematic top view of the essential portion of the bill transfer device shown in FIG. 1.

FIG. 1 is a schematic cross sectional view of the essential portion of a bill transfer device according to the present invention. FIG. 2 is a schematic top view of the essential portion of the bill transfer device shown in FIG. 1. In FIGS. 1 and 2, the same numerals are assigned to the same components as those shown in FIGS. 3 and 4.

A bill transfer device 1 comprises bill transfer means 31 including bill transfer rollers 32 for transferring bills inserted from a bill insertion port not shown in the drawing along a bill transfer path 30, magnetic heads 35 for discriminating the truth of the bills transferred by the bill transfer means 31, and grounding means 11 for grounding static electricity that is generated in the bill transfer rollers 32 by such actions as the friction with transferring bills and the drive of the magnetic heads 35.

Among these components, the grounding means 11 comprises a pair of coil springs 12 made of an electrically conductive material and a circuit pattern 14 for grounding formed on an lower face 13*a* of a printed circuit board 13.

Each of the coil springs 12 has one end 12*a* that is in contact with a shaft 33 and another end 12*b* that is in contact with the circuit pattern 14 for grounding. The coil springs 12 always press each of the bill transfer rollers 32 toward the bill transfer path 30 via the shaft 33.

In the circuit pattern 14 for grounding, a lead terminal 16 for grounding outside the bill transfer device 1 is connected to substantially the center of the top face thereof and another end 12*b* of each of the coil springs 12 is in contact with an lower face 14*a* thereof.

The printed circuit board 13 wherein the circuit pattern 14 for grounding is formed is fixed to an upper chute 52 by screws 48 in the same way as in the conventional device, and circuit patterns 47 (FIG. 2) for controlling the whole processing of bills such as bill transfer are formed on the printed circuit board 13 in the same way as in the conventional device.

The bill transfer rollers 32 are made of synthetic resin.

The bill transfer device 1 transfers bills inserted from a bill insertion port (not shown in the drawing) along the bill transfer path 30 by the bill transfer means 31, and drives the magnetic heads 35 when the bills pass between the magnetic heads 35 and the bill transfer rollers 32 thereby to discriminate the truth of the bills. When the bills are discriminated as true bills by the magnetic heads 35, the bill transfer device 1 further transfers the bills to the downstream of the bill transfer path 30 by the bill transfer means 31 and stores them in a stacker (not shown in the drawing). When the bills are discriminated as false bills, the bill transfer device 1 reversely drives the bill transfer means 31 and returns the false bills from the bill insertion port.

To assemble the bill transfer device 1, the pair of coil springs 12 are arranged so that the one ends 12*a* thereof come in contact with the shaft 33 and then the printed circuit board 13 is positioned so that the other ends 12*a* come in contact with the circuit pattern 14 for grounding and fixed to the upper chute 52 by the screws 48.

Then, the coil springs 12 are fixed to the upper chute 52 directly at the other ends 12*b*.

Since the bill transfer device 1 of this kind has the coil springs 12 and the grounding means 11 including the circuit pattern 14 for grounding, static electricity generated in the bill transfer rollers 32 made of synthetic resin due to friction with transferring bills and others can be discharged via the shaft 33, the coil springs 12, and the circuit pattern 14 for grounding.

Therefore, a risk of static electricity staying in the bill transfer rollers 32 is prevented and hence a risk that the operation of the printed circuit board 13 may be adversely affected by staying of the static electricity, that is, malfunctions of the bill processing of the printed circuit board 13 may be caused is prevented.

Further, since the bill transfer device 1 has the coil spring s 12 and the grounding means 11 including the circuit pattern 14 for grounding, as shown in FIG. 2 in addition, when the bill transfer rollers 32 are arranged opposite to the magnetic heads 35, static electricity generated in the bill transfer rollers 32 made of synthetic resin by drive of the magnetic heads 35 can also be discharged via the shaft 33, the coil springs 12, and the circuit pattern 14 for grounding.

Therefore, a risk of static electricity staying in the bill transfer rollers 32 is prevented and hence a risk that the operation of the printed circuit board 13 may be adversely affected by staying of the static electricity, that is, malfunctions of control may be caused is prevented.

As mentioned above, when the pair of coil springs 12 are arranged so that the one ends 12*a* thereof come in contact with the shaft 32 supporting the bill transfer rollers 32 and then the printed circuit board 13 is positioned so that the other ends 12*b* come in contact with the circuit pattern 14 for grounding and the printed circuit board 13 is also fixed to the upper chute 52 by the screws 48, the bill transfer device 1 can be assembled and when the printed circuit board 13 is fixed to the upper chute 52 by the screws 48, the coil springs 12 can be directly fixed to the upper chute 52 at the other ends 12*b*.

Therefore, as compared with the conventional device in which the coil springs 12 are fixed to the upper chute 52 via the plate member 44 or 45 (FIG. 3) and the screws 46 (FIG. 3) and further the printed circuit board 13 is fixed to the upper chute 52 by the screws 48, the plate members 44 and 45 and the screws 46 are not provided in the device of the present invention. Therefore, the number of components can be reduced. Further, since the operation for fixing the coil springs 12 to the upper chute 52 via the plate members 44 and 45 and the screws 46 is not required, the manufacturing process can be simplified.

In this embodiment, the magnetic heads 35 are arranged in the locations opposing the bill transfer rollers 32 in the neighborhood of the printed circuit board 13 across the bill transfer path 30. However, the present invention is not limited to it, and in the opposite locations of the bill transfer rollers 32, the drive rollers may be arranged.

In the bill transfer device 1 of this embodiment, the grounding means 11 comprises the coil springs 12. However, other grounding means may be used as far as it has an electrically conductive force applying means. For example, the grounding means 11 may be metallic plate springs instead of the coil springs 12.

In this embodiment, a bill transfer device is explained as an example of the sheet material transfer device. However, the present invention is not limited to it and a transfer device for transferring any type of sheet material is applicable. For example, a card transfer device that transfers cards is applicable.

As described above, the sheet material transfer device of the present invention comprises at least the sheet material transfer rollers which can freely move vertically and arranged in the sheet material transfer path in the neighborhood of the printed circuit board and supported so as to freely rotate about the electrically conductive shaft, and the grounding means for grounding static electricity generated in the sheet material transfer rollers, wherein the grounding means includes the circuit pattern for grounding formed on the printed circuit board and of the electrically conductive force applying means having one end in contact with the shaft and another end in contact with the circuit pattern for grounding for always pressing the sheet material transfer rollers toward the sheet material transfer path, so that the sheet material transfer device can discharge static electricity generated in the sheet material transfer rollers made of synthetic resin due to friction with the transfer sheet material through the shaft, the force applying means, and the circuit pattern for grounding and also the electrically conductive force applying means constituting the grounding means is directly fixed to the upper chute at the other end thereof by fixing the printed circuit board to the upper chute by means of the screws. With this configuration, a risk of static electricity staying in the sheet material transfer rollers is prevented. Therefore, as compared with the conventional device in which the force applying means is fixed to the upper chute 52 via the plate members and the screws as conventional device and the printed circuit board is further fixed to the upper chute by other screws, since the plate members and screws for fixing the plate members to the upper chute are not used, the number of components can be reduced and since the operation for fixing the force applying means to the upper chute via the plate members and screws is not required, the manufacturing process can be simplified.

Since the sheet material transfer device according to the present invention prevents the stay of static electricity of the sheet material transfer rollers in the neighborhood of the printed circuit board, malfunctions of the sheet material processing by the printed circuit board can be prevented with smaller number of components and simple manufacturing process.

The present invention can be executed in other various forms without deviating from the spirit thereof or major characteristics. Accordingly, the above-described embodiment is only an example in every respect and must not be interpreted limitatively. The scope of the present invention is indicated by the claims of the patent but not restricted by the text of the specification. Furthermore, deformations and changes covered by the equivalence to the scope of the claims of the patent are all within the scope of the present invention.

What is claimed is:

1. A sheet material transfer device comprising:

a pair of sheet material transfer rollers disposed with a predetermined space therebetween along a width direction of a sheet material transfer path, the transfer rollers being connected by an electrically conducting shaft, which is rotatably supported and movable in vertical directions;

a pair of magnetic heads disposed opposite to the pair of sheet material transfer rollers with the sheet material transfer path therebetween, for reading data stored in a sheet material as the sheet material is transferred along the sheet material transfer path;

a guide member disposed between the pair of sheet material transfer rollers, for guiding the pair of sheet material transfer rollers in vertical directions;

a printed circuit board disposed above the sheet material transfer path;

a fixing member for fixing the printed circuit board to the sheet material transfer path; and grounding means for grounding static electricity generated in the sheet material transfer rollers, wherein the grounding means comprises:

a circuit pattern for grounding formed on the printed circuit board;

force applying means made of electrically conductive material disposed between the sheet material transfer rollers and the guide member, and having one end in contact with the shaft and another end in contact with the circuit pattern for grounding, for always pressing the shaft toward the magnetic heads side; and a grounding lead wire directly connected to the circuit pattern for grounding;

wherein, after placing the one end of the force applying means in contact with the shaft, by positioning the printed circuit board with respect to the sheet material transfer path so as to make the another end of the force applying means in contact with the circuit pattern for grounding, and by fixedly mounting the printed circuit board thus positioned to the sheet material transfer path by means of the fixing member, the force applying means is fixed with respect to the sheet material transfer path and the sheet material transfer rollers are always pressed to the magnetic heads, whereby static electricity generated in the sheet material transfer rollers in discharged through the shaft, the force applying means, the circuit pattern for grounding and the grounding lead wire.

* * * * *